United States Patent [19]

Fisher et al.

[11] 4,312,172

[45] Jan. 26, 1982

[54] AUTOMATIC LID PLACING APPARATUS FOR LARGE PLASTIC LIDS AND METHOD FOR PLACING LIDS

[75] Inventors: Warren Fisher; Frank J. Smith, Jr., both of Bricktown, N.J.

[73] Assignee: United States Gypsum Company, Chicago, Ill.

[21] Appl. No.: 130,316

[22] Filed: Mar. 14, 1980

[51] Int. Cl.[3] ..... B65B 7/28; B67B 3/062; B67B 3/22; B67B 3/26

[52] U.S. Cl. ..... 53/489; 53/505; 53/506; 53/72; 53/76; 53/314; 53/316; 53/320; 53/333; 221/14

[58] Field of Search ..... 53/505, 506, 72, 471, 53/76, 487, 489, 320, 319, 321, 333, 314, 315, 313, 316; 221/13, 14, 311, 312 R, 279, 280

[56] References Cited

U.S. PATENT DOCUMENTS

| | | | |
|---|---|---|---|
| 1,711,540 | 5/1929 | Reifsnyder | 53/321 |
| 2,500,437 | 3/1950 | Tandler et al. . | |
| 2,500,438 | 3/1950 | Tandler et al. . | |
| 2,734,673 | 2/1956 | Hazel et al. | 53/314 |
| 3,185,851 | 5/1965 | D'Emilio . | |
| 3,196,276 | 7/1965 | Naab . | |
| 3,350,842 | 11/1967 | Renish | 53/316 |
| 3,495,252 | 2/1970 | Hamlin | 53/316 X |
| 3,715,865 | 2/1973 | Davis | 53/319 |
| 3,924,384 | 12/1975 | Kinney | 53/314 X |
| 3,938,697 | 2/1976 | Kinney | 53/313 X |
| 4,040,513 | 8/1977 | Walls | 53/316 X |
| 4,095,390 | 6/1978 | Knudsen | 53/314 X |
| 4,122,649 | 10/1978 | Sawvel | 53/314 X |

*Primary Examiner*—Horace M. Culver

*Attorney, Agent, or Firm*—Jerome J. Adams; Robert H. Robinson; S. Kurlandsky

[57] ABSTRACT

An apparatus and method for automatically placing large plastic lids onto containers. Lids 24 are dispensed individually from magazine 11 onto slide 33. Each dispensed lid is individually retained at the bottom of the slide 33 for pickup by a container 41. The lid is urged onto the container by a pivoted roller 47 and further leveled by a roller 58 which is extended twice by a pneumatic piston to first contact a leading edge of the lid and to secondly contact a trailing edge of the lid. Thereafter a pneumatically operated lid securement means 61 comprising a convex plate 70' burps the air from beneath the lid and fully seats the lid on the container. The apparatus has various sensing means for sensing the depletion of lids from magazine 11, for sensing that a lid has been dispensed onto slide 33 and for sensing a container at the capping station. The sensing means control the various operations of the machine in proper sequence.

27 Claims, 5 Drawing Figures

AUTOMATIC LID PLACING APPARATUS FOR LARGE PLASTIC LIDS AND METHOD FOR PLACING LIDS

An apparatus for automatically placing large plastic lids is disclosed, said apparatus comprises a magazine section, drive means comprising a motor cooperative with a brake and clutch assembly driving the magazine section for advancing plastic lids; slide means adjacent one end of the magazine for receiving falling plastic lids as they discharge from the magazine section, said slide means including stop means at a lower portion thereof for holding a plastic lid at said lower portion wherein a lid is retained with a leading portion extending beyond the lower portion of the slide means; conveyor means capable of continuously advancing pail receptacles below said lower portion of the slide means wherein the conveyor means is disposed below said slide means permitting an upper rim of a pail receptacle to positionally correspond with the portion of the lid extending below the lower portion of the slide plate facilitating a leading rim edge of an advancing pail to catch a lid lip and pull it from the slide means; guiding means providing a downward force and comprising a roller supported by hinged arms for rolling over upper surfaces of lids to guide lids into position from the guide means onto a pail receptacle; presetting means comprising an air cylinder and piston assembly having a vertically disposed piston actuated by switch means triggered by advancing pail receptacles which actuate the piston to tap an upper edge of the lid thereby pre-setting a lid on a pail receptacle; lid leveling means comprising a horizontally fixed roller wherein the roller is disposed at a height sufficient to rotate and contact across an upper surface of an advancing lid and position the lid in a generally horizontal plane on a pail receptacle; lid securement means for final lid placement comprising pail receptacle detaining means cooperative with an air cylinder and piston assembly, said lid securement means activated in response to switch means triggered by an advancing pail receptacle, whereby said pail receptacle detaining means momentarily detains a pail receptacle on the continuously moving conveyor means in registry with said piston whereupon said air cylinder is sequentially activated causng said piston to descend and press atop a lid to place it firmly atop the detained pail receptacle; and, electric circuit means correlating apparatus operations to automatically sequence magazine advancement by controlling engagement of the magazine drive means by said brake and clutch assembly activating in reponse to the electric eye means at the slide plate, and by controlling the conveyor means and magazine drive means responsive to the platen advancing to a pre-determined position in the magazine whereby said platen triggers a switching means and said conveyor drive means and magazine drive means are de-energized facilitating re-loading of the magazine section.

A method for placing large plastic lids is also disclosed, said method comprising the steps of: loading lids in a magazine section with lids disposed vertically in juxtaposition; advancing the lids in the magazine; compressing a group of lids in an end portion of the magazine section; discharging a lid from the magazine section to fall onto a slide plate while retaining a next adjacent sequential lid in the magazine section; sliding a lid down a slide plate by gravity plate by gravity; retaining a lid at a lower portion of the slide plate at stop means; stopping engagement of magazine drive means upon retention of a lid at the stop means; continuously conveying pail receptacles on conveyor means beneath said slide plate; catching a lip portion of a lid at a leading rim edge of a pail receptacle; dispensing a lid from the slide plate by means of the pail rim edge pulling the lid off the stop means; guiding the lid into position onto a pail receptacle; re-engaging the drive means and advancing a next adjacent sequential lid to discharge from the magazine section and fall onto the slide plate; conveying a pail and lid on said conveyor means; tapping the lid to pre-set position atop a pail receptacle by means of a moving pail receptacle triggering switch means to activate an air cylinder and piston assembly thereby motivating a piston means to descend and tap the lid; leveling the lid in pre-set position atop the pail receptacle by use of a horizontally disposed roller contacting an upper surface of said lid; securing a lid to a pail receptacle by an advancing pail triggering switch means, said switch means activating pail detaining means and momentarily detaining a pail on said conveyor means while sequentially activating an air cylinder and piston assembly causing said piston to descend and press atop a lid to burp and snap the lid firmly in place atop the pail receptacle; advancing a pail and lid on the conveyor means away from the air cylinder and piston assembly; and, automatically repeating the sequence of steps for the next sequential lid thereby continuously placing lids atop pail receptacles.

BACKGROUND OF THE INVENTION (1) Field of the Invention

The invention relates to an apparatus for automatically placing large plastic lids atop pail receptacles and a method for placing large plastic lids atop pail receptacles.

(2) Description of the Prior Art

Despensing and capping devices for a variety of containers are well known. For example, the milk industry has long utilized such devices for affixing bottle caps to bottles by equipment which dispenses one lid at a time and then affixes the lid over the bottle opening. Other areas of the food industry similarly have become proficient in capping a wide array of containers for perishable commodities. Different industries, such as the paint industry, have also developed methods for affixing lids to metal cans for paint, adhesives, petroleum products, joint compounds, and various materials.

In general, the lidding of conainers utilizes a magazine storage with means for advancing selective numbers of lids. Many forms of advancement are extant, and vertical, inclined, and horizonal magazine sections are utilized. Generally, however, such dispensing and capping equipment envisions smaller type lids such as those for necked-down bottles, medicine vials, wide-mouth jars for comestible contents, metal pails for petroleum and paint products, and various other typically circular containers. The food vending machine industry has solved problems of dispensing individually pre-packaged goods but has not had to deal with capping large receptacles. With the use of lids less than about six to eight inches in diameter, problems with non-uniformity and deformation are not encountered since the size tolerances and behavior of the material used is less variable. When large size receptacles, such as multiple-gallon pails, are lidded, magazine dispensation becomes difficult and the capping or placing onto the receptacle is manually performed.

Particularly large receptacles generally are covered with metal, or high density plastic, lids. One example of large metal lids would be in sealing large containers of asphalt emulsion, or tar, used in paving, roofing, and other construction-type industries. The inventor has particular concern for the utilization of high density plastic lids, specifically high density polyethylene. The prior art does not disclose a sufficiently adequate method or apparatus for both dispensing and placing such types of circular lids. A characteristic of high density polyethylene is that it tends to bow up in hot weather, which hinders automatic lidding operations. Additionally, the polyethylene type lid has been found to be supplied in non-uniform diameters, irregular rim sealing lips, and non-unifrom skirt lip dimensions. Such vagaries of dimension hamper lidding operations and implementation of an automatic method and apparatus for lidding large pail-type receptacles.

It has been discovered that additional problems relate to the sequence of filling and registering pail-type containers for subsequent lidding. This is problematic in that the spacing for larger containers, such as five gallon pails, may become random after proceeding along conventional conveyor belts, or the like, rather than neatly organized space-apart intervals as could be attained for example with small jars or cans. The problem is compounded when attempting to sequentially dispense one large lid at a time for affixation to the upper rims of the pails. The two steps of filling and lidding are desirably coordinated so that continuous operation is afforded.

(3) Objects of the Invention

It is accordingly a primary goal of this invention to provide a method and apparatus for automatically dispensing and lidding large pail-type receptacles with large diameter plastic lids.

It is moreover a critical object of the invention to provide such automatic placing when non-uniform plastic lids are used.

It is an allied goal of the invention to lid pail-type receptacles, having upper circular rim portions, with high density polyethylene lids having a peripheral skirt or lip portion.

It is an important goal of this invention to provide a method and apparatus which allows for dispensing and lidding pail-type receptacles one at a time wherein filled pail containers may be advanced after a filling operation through a lid placing operation without regard to spacing and without sacrificing a continuous operation.

SUMMARY OF THE INVENTION

In satisfying all the aims, objects and goals of the invention an apparatus for automatically placing large plastic lids is provided and a method for automatically placing large plastic lids onto pail-type receptacles is provided.

These aforementioned objects are satisfied with the disclosure herein of an automatic placing apparatus for large plastic lids which comprises: a magazine section capable of storing juxtaposed plastic lids, said magazine section having lid advancing means comprising at least one threaded rod for advancing an engaged platen and thereby push said lids to advance along lid support portions extending between plate members of the magazine section, said threaded rod supported at opposing ends by said plate members and seated in bearings permitting rotation of a threaded rod, said magazine section having a compression section for holding lids tightly facilitating discharge of only one lid at a time, said compression section including a lid discharging means included at one of said plate members facilitating discharge of lids; drive means comprising a motor and cooperative brake and clutch assembly controlling rotation of a threaded rod of the magazine section to effect advancement of plastic lids therein, said drive means facilitating discharge of one lid at a time; slide means for receiving lids discharging from the magazine section, said slide means comprising an inclined plate capable of receiving falling lids as they are discharged and allowing lids to slide downwardly by gravity to a lower portion thereof, stop means extending from said inclined plate for retaining lids in a disposition wherein a portion of a circumferential lid lip extends beyond said inclined plate, said slide means associated with an electric eye means capable of detecting a lid retained by said stop means wherein said electric eye signals said brake and clutch assembly of the drive means to disengage the motor upon detection of a lid in the retained position and wherein said electric eye signals said brake and clutch assembly to re-engage the motor when a lid is not retained; conveyor means including conveyor drive means actuating a moving horizontal surface for transporting pails, said conveyor means advancing pails in a lineal direction, said conveyor means disposed below the slide means at a sufficient distance whereby upper rim portions of pail receptacles encounter said portion of a lid lip extending below the lower portion of the slide means when in the retained position, whereby as said pail receptacles advance, a leading edge of the upper rim of the pail receptacle encounters said extending portion of the lid lip and draws a lid off said stop means to dispense atop the pail receptacle rim, said dispensing of a lid from the slide means being detectable by said electric eye means to thereby signal re-engagement of the motor by the brake and clutch assembly effecting rotation of a threaded rod of the magazine section and advancement of lids permitting discharge of the next sequential lid from the magazine section; guiding means to guide a lid onto a pail receptacle, said guiding means comprising a roller supported by hinged arms wherein said roller is disposed adjacent said slide means to allow rolling contact across upper surfaces of a lid and thereby guide a lid onto a pail receptacle while it dispenses from the slide means; air cylinder means for pre-setting lids on said pails, said air cylinder means cooperative with switch means disposed along the conveyor means triggered by advancing pail receptacles thereby activating the air cylinder means causing a piston means to tap a lid into pre-set engagement along the circumferential lid lip around the upper rim of a pail receptacle; lid leveling means for positioning lids on pail receptacles in a generally horizontal disposition, said lid leveling means comprising a horizontally fixed roller, said roller positioned at a height sufficient to rotate and contact across an upper surface of an advancing lid thereby leveling lids in a generally horizontal disposition; lid securement means for final lid placement comprising pail receptacle detaining means cooperative with an air cylinder and piston assembly, said lid securement means activated in response to switch means triggered by an advancing pail receptacle whereby said pail receptacle detaining means momentarily detains a pail receptacle on the continuously moving conveyor means in registry with said piston whereupon said air cylinder is sequentially activated causing said piston to descend and press atop a lid to place it firmly atop the detained pail receptacle; and, electric circuit means correlating apparatus operations to automatically sequence magazine advancement by controlling engagement of the magazine drive means by said brake and clutch assembly activating in response to the electric eye means at the slide plate, and by controlling the conveyor drive means and magazine drive means responsive to the platen advancing to a predetermined position in the magazine section whereby the platen triggers a switching means whereby said conveyor drive means and magazine drive means are de-energized facilitating reloading of the magazine section, wherein said automatic placing apparatus facilitates sequentially affixing large plastic lids on pail receptacles despite non-uniformities of plastic lids supplied.

The objects of the invention, as previously set forth, are further satisfied by the provision of a continuous method for placing large plastic lids which comprises the steps of: loading plastic lids in a magazine section with said lids positioned in a juxtaposed relationship; advancing said lids in the magazine section by drive means cooperating with the magazine section; compressing lids edgewise to hold them tightly in an end compression portion of the magazine section; discharging lids one at a time from the compression portion of the magazine section; sliding a lid down an inclined plate by gravity; retaining a lid at a lower portion of the inclined plate with a portion of a circumferential lid lip extending beyond said inclined plate; stopping the magazine drive means upon retention of a lid on the inclined plate; continuously conveying pail receptacles by conveyor means extending below the lower portion of the inclined plate; catching said extending portion of a lid lip with a leading rim edge of an advancing pail receptacle passing passing beneath the lower portion of the inclined plate; dispensing a lid from the inclined plate by means of an advancing pail receptacle drawing a lid off the inclined plate; guiding a discharging lid by roller means contacting upper surfaces of the lid while a lid dispenses atop a pail receptacle; re-starting the magazine drive means thereby advancing a sequential lid to discharge from the magazine section and thereafter slide down the inclined plate to the retained position; conveying a pail receptacle and lid on the conveying means; tapping the lid by means of an air cylinder and piston assembly to preset the lid lip around an upper rim of the pail receptacle; leveling a preset lid on a pail receptacle by means of a horizontally disposed roller to position the pre-set lid in a generally horizontal disposition; setting the lid in final placement onto the pail receptacle by momentarily detaining the pail on the conveyor means, burping the lid, and snapping the lid lip around the pail rim by means of a second air cylinder and piston assembly; and, advancing the pail and affixed lid along the conveyor means.

DESCRIPTION OF THE PREFERRED EMBODIMENT

Figure 1:
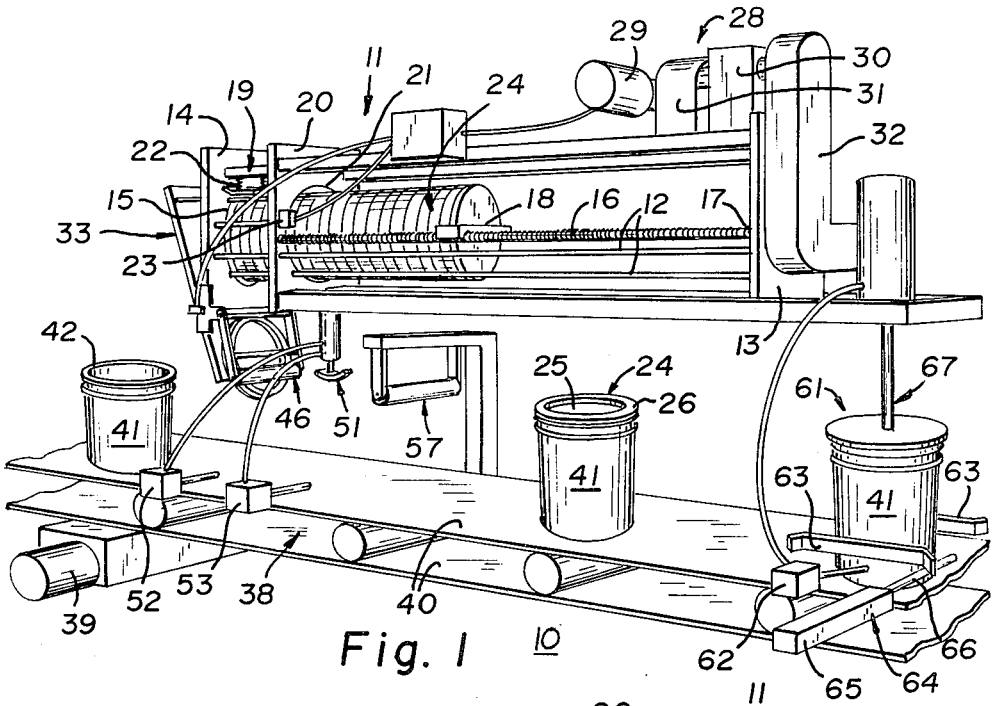
FIG. 1 is a perspective view of the automatic lid placing apparatus for large plastic lids in the preferred embodiment of the invention.

The Figures illustrate a preferred form for the apparatus and method for automatically placing large plastic lids on pail receptacles. Reference is first made to FIG. 1 wherein a perspective view of the apparatus for performing the method herein disclosed. Lid placing apparatus 10 is shown in a stop-action during a portion of a continuous operation. Lid placing apparatus 10 continuously and automatically operates. Prior to beginning operations, magazine section 11 is loaded with lids 24. Magazine section 11 is preferably in a horizontal disposition, but may be inclined upwardly or downwardly within the scope of the invention. Support rods 12 extend between a first plate 13 and a second plate 14 for lid support thereon. Second plate 14 includes an opening 15 permitting discharge of lids from magazine section 11. Lid advancement is obtained by the provision of threaded rods 16 which are supported by bearings 17 at first plate 13 and intermediate plate 20. Intermediate plate 20 has opening 21 therethrough permitting lids 24 to enter compression portion 19. As better seen when additionally viewing FIG. 2, compression portion 19 is defined by intermediate plate 20 at one end and second plate 14 at the other. Compression portion 19 includes spring means 22 which compress lids 24 facilitating discharge of one lid at a time. Compression of lids is effected by compressing lids edgewise transverse to the direction of advancement, and hence, spring means 22 may be positioned at varying locations around lids 25 in compression portion 19. Continuous lid advancement is attained by the additional provision of platen assembly 18. Platen assembly 18 is engaged by threaded rods 16 and advances as threaded rods 16 rotate. Platen assembly 18 has compatible threading facilitating this advancement. Adjacent intermediate plate 20 resides shut-off switch 23 which is arranged to be contacted by platen assembly 18 when advanced to that position. At this position shut-off switch 23 is triggered and de-energizes lid placing apparatus 10 for re-loading of magazine section 11. Actuating threaded rods 16 is magazine drive means 28. Magazine drive means 28 includes electric motor 29, which is of a conventional design and preferrably of about ¼ horse power. Other than upon activating of shut-off switch 23, it is desirable that electric motor 29 continuously operate but be engagable and disengagable to thereby sequentially advance and discharge a single lid 24 at a time. Magazine drive means 28 affords stop and start rotation of threaded rods 16. The linkage between drive means 28 and threaded rods 16 is facilitated by belt drive linkage 32 of a conventional design. When cooperating brake 30 is activated, clutch 31 disengages electric motor 29 and lid advancement stops. When brake 30 is disengaged, clutch 31 engages, thereby magazine drive means 28 actuates rotation of threaded rods 16 for advancement of lids 24.

Figure 2:
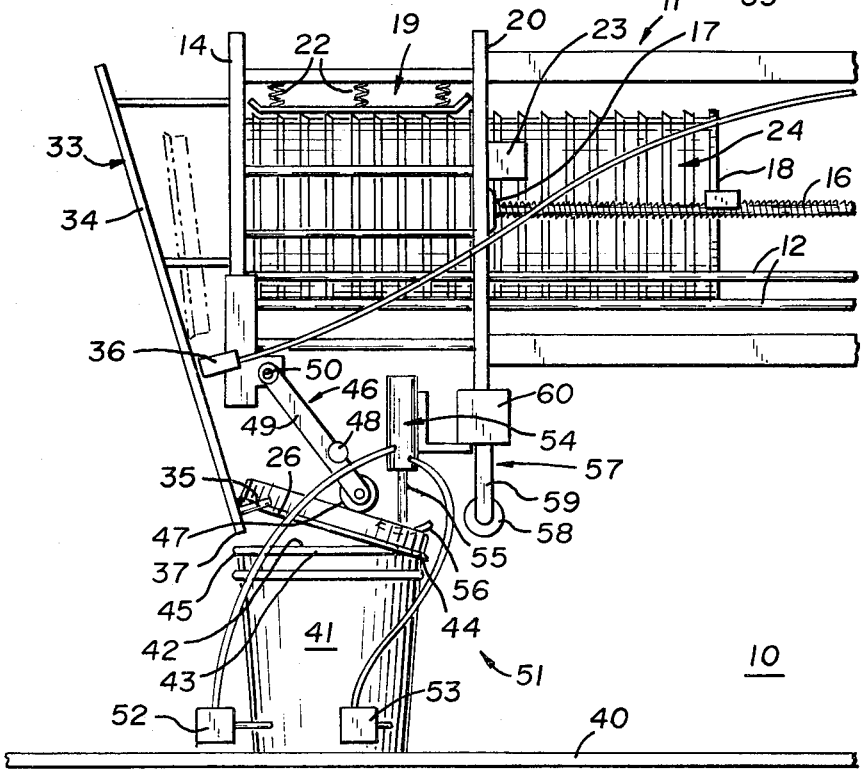
FIG. 2 is an elevational view of a portion of the apparatus as shown in FIG. 1.

Continuing further with FIG. 1, and additionally, FIG. 2 upon discharge of lids 24, one at a time, through opening 15 of second plate 14, a lid 24 falls by gravity onto slide means 33. It is preferred that lids 24 are initially loaded in magazine section 11 with peripheral lips 26 extending in the direction of advancement. Peripheral lip 26 is a skirt-like lid portion extending from a central circular plate 25. Peripheral lip 26 meets circular plate 25 at a trough portion 27 which facilitates sealing along upper rims 42 of pail receptacles 41. With peripheral lip 26 of lids 24 projecting in the direction of advancement, when discharged, they fall with the peripheral lip 26 ultimtely contacting on an inclined plate 34 of slide means 33. Inclined plate 34 is preferably a simple planar element, but helical, angled, or curved conformations which allow sliding downwardly by gravity are some alternatives. Lids 24 slide downwardly and are retained at stop means 35 at a lower portion 37 of inclined plate 34. In this embodiment, stop means 35 comprises pegs, or projections, extending outwardly from inclined plate 34. Stop means 35 is located in a disposition whereby lower portions of lids 24 may extend beyond lower portion 37. Thereby, peripheral lip 26 partially extends beyond lower portion 37. Disposed below slide means 33 is conveyor means 38. Conveyor means 38 is driven by conveyor drive means 39 comprising a conventional electric motor assembly. Conveyor drive means 39 and magazine drive means 28 are continuously energized until shut-off switch 23 is contacted by platen assembly 18 as described. Conveyor drive means 39 activates a continuously moving surface 40 in a generally horizontal direction. Atop moving surface 40 resides continuously advancing pail receptacles 41. It is envisioned that pail receptacles 41 move from a previous filling operation with materials to be shipped therein and then advanced to lid placing apparatus 10. While a particular filling operation is not limited for use with this invention, it would be economically desirable that any filling operation of pail receptacles 41 cooperate with conveyor means 38 such that lid placement may be facilitated in sequence. Pail receptacles 41 are of a conventional design with an upper rim 42 and a rib 43 extending therearound for snap-on lid engagement. The material comprising pail receptacles 41 and lids 24 is envisioned as being high density plastic material. As previously discussed, problems with utilizing high density plastics, such as polyethylene, include: non-uniformity of the thicknesses; warpage; varying diameters; and, other irregularities, which previously have permitted only manual lid placement operations. Such non-uniformities and heat distortion characteristics are accommodated by the invention herein disclosed and the lid placement operation can be continuously occurring, thus saving considerable time and effort otherwise involved with such manual placement.

As used in this disclosure, the term large plastic lids, encompassing lids 24, reflect those having diameters in the range of from about 6" to about 18" with skirt or lip portions 26, having a dimension of from about ¼" to about 2" extending from the full periphery of the circular plate 25. The thickness for high density plastics, and particularly polyethylene, is suitably of a range of from about 50 mils to about 150 mils. The thickness is not critical to this invention and would be subject to the shipping and handling characteristics of the material to be containerized. Additionally, the height of the pails may vary as particular operations prescribe. Lid placing apparatus 10 provides the additional feature of such adaptability by allowing support rods 12 and threaded rods 16 of magazine section 11 to be adjustable for accomodation of varying size lid diameters. Additional alterable characteristics of lid placing apparatus 10 will be described hereinafter.

Upon retaining lids 24 at stop means 35, continuously advancing pail receptacles 41 approach the extending portion of lids 24. A leading edge 44 of a pail receptacle 41 positionally corresponds with this extending portion of lids 24. Leading edge 44 is defined as the first approaching point along upper end 42. A trailing edge 45 is diametrically opposed in the direction of advancement as would be well understood. As conveyor means 38 advances pail receptacles 41, leading edge 44 encounters peripheral lip 26 of a lid 24. As the advancement continues, a pail receptacle 41 draws off a lid 24 from stop means 35. As the drawing off, or dispensing, of a lid 24 takes place, an electric eye sensor means 36, mounted on inclined plate 34, detects the absence of a lid 24 and signals brake 30 and clutch 31 for re-engagement of magazine drive means 28 to rotate threaded rods 16 and advance and discharge a next sequential lid 24. Then a sequential lid 24 discharges from second plate 14, falls atop inclined plate 34 and slides downwardly along inclined plate 34 to be stopped at stop means 35 for disposition onto a next pail receptacle 41. Electric eye sensor means 36 detects a retained lid 24 and signals brake 30 and clutch 31 for disengagement of magazine drive means 28. As lid 24 is drawn off by a pail receptacle 41, guiding means 46 is encountered facilitating positioning of a lid 24 atop an upper rim 42. Guiding means 46 comprises roller 47 with a weight 48 disposed above it. Both roller 47 and weight 48 are suspended by hinged arms 49 which are supported at hinges 50. Hinged arms 49 facilitate rotational movement of guiding means 46 allowing roller 47 to follow a lid 24 onto position atop an upper rim 42. During such positioning, roller 47 rolls and contacts across upper portions of lids 24 and afterward swings back to plumb position awaiting the next advancing pail receptacle 41 drawing a lid 24 from stop means 35. The view shown in FIG. 2 specifically illustrates the discharging, sliding, retaining, dispensing, and guiding steps, and apparatus therefor, when viewed conjunctively with FIG. 1.

With additional reference to FIG. 1 and FIG. 2, the next sequential operation and apparatus for lid placement is depicted wherein a pre-setting means 51 is involved. As an advancing pail receptacle 41 moves from guiding means 46 with a lid 24 positioned thereon, the pail receptacle 41 contacts switch means 52. Switch means 52 is disposed along and adjacent conveyor means 38 to be triggered by advancing pails. Switch means 53 is preferably included as an additional switch means for contact by advancing pail receptacles 41. Switch means 52 and 53 are connected to air cylinder assembly 54 having piston 55 cooperative therewith. Piston 55 terminates in a foot portion 56 for contacting upper portions of lid 24. When contacted, switch means 52 and 53 individually actuate air cylinder assembly 54 which causes piston 55 to descend. If a single switch means such as switch means 52, is solely used, air cylinder assembly 54 is activated only once for pre-setting a lid lightly atop a pail receptacle 41. The point at which a lid 24 is contacted is determined by a time delay switch, later described, wherein the air cylinder assembly 54 is actuated as set by the time delay. Preferably, when both switch means 52 and 53 are utilized, air cylinder assembly 54 is thereby actuated twice and piston 55 descends to contact firstly at a point on a lid 24 above leading edge 44 of a pail receptacle 41 and secondly at a point on a lid 24 above trailing edge 45. With this double-tapping a lid 24 is thus lightly pre-set along upper rim 42 slightly engaging rib 43 thereof. Such pre-setting is necessary immediately after a lid 24 dispenses from slide means 33 due to the above expressed irregularities and non-uniformities encountered with high density plastic materials. Additionally, during warm indoor conditions, such as in excess of 80° F., high density plastic materials, such as polyethylene, tend to warp, or bow up, and thus a lid 24 could vibrate out of position on a pail receptacle 41 if pre-setting means 41 were not provided. Foot 56, which is fixed at the bottom of piston 55, is curved slightly to allow for vertical non-uniformities in lids 24.

Figure 3:
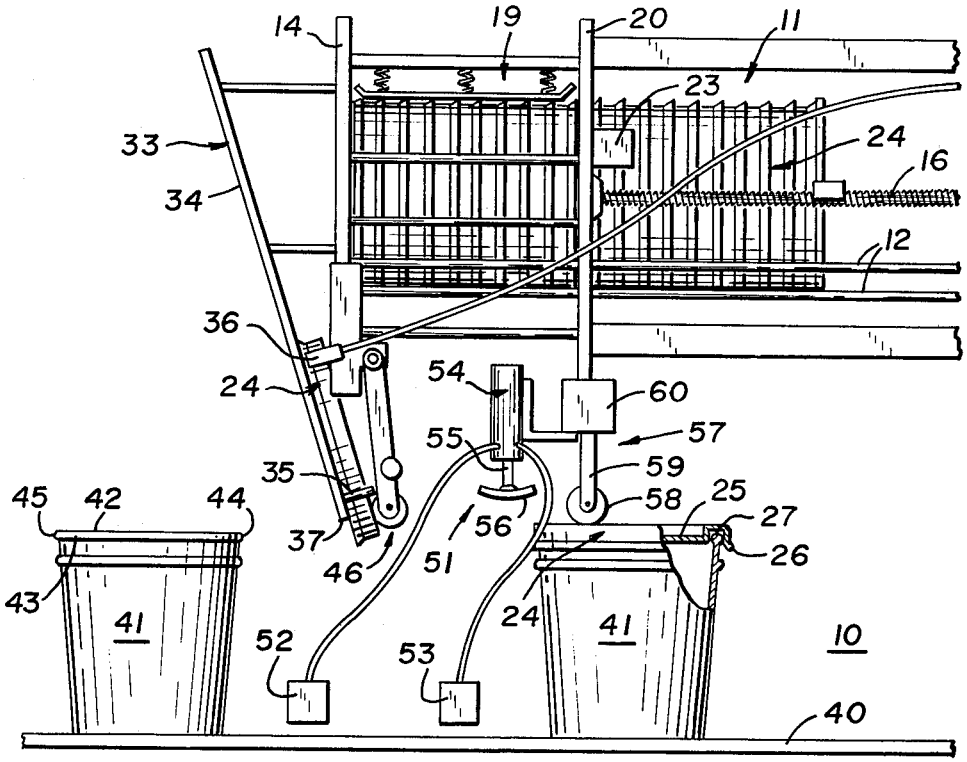
FIG. 3 is an elevational view of a portion of the apparatus as shown in FIG. 1.

As shown in FIGS. 1, 2, and 3, a leveling means 57 is also provided sequentially adjacent pre-setting means 51. Leveling means 57 is desirable in order to position lids 24 in a generally horizontal disposition facilitating a later-described final lid securement. Leveling means 57 comprises roller 58 attached at opposite ends by fixed arms 59 which depend from support member 60. Roller 58 is vertically disposed to roll and contact across upper surfaces of lid 24 for such leveling. Both pre-setting means 51 and leveling means 57 can be vertically adjustable thereby allowing accomodation of different size lids and pail receptacles. Additionally, switch means 52 and 53 may be adjustable transverse to the direction of advancement along moving surface 40 for contact with differing size pail receptacles 41.

As a pail receptacle 41, with lightly affixed lid 24, passes leveling means 57 a next sequential pail receptacle 41 can advance along moving surface 40 and draw off a sequential lid 24 held on slide means 33 by stop means 35. Thus, as a pail receptacle 41 is being lidded, a next pail receptacle 41 can continuously advance for lidding. The utilization of electric eye sensor means 36 facilitates signaling brake 30 and clutch 31 to engage and disengage electric motor 29 thereby sequentially advancing lids from magazine section 11 one at a time for such operation.

With specific reference now to FIGS. 1 and 3, the sequence of lidding pail receptacles 41 is further illustrated wherein a first pail receptacle 41 is shown having a lid 24 being leveled by leveling means 57 while the next sequential pail receptacle 41 approaches slide means 33 for drawing off a lid 24 retained by stop means 35. Leading edge 44 of the second pail receptacle 41 is shown as it progresses in positional correspondence with the lower portion of a lid 24 extending beyond lower portion 37 of inclined plate 34 effectuating this dispensing from stop means 35. It is thus apparent that continuous lid placement can occur by the cooperation of the described components of lid placing apparatus 10. Importantly, the spacing of pail receptacles 41 is not critical and may be random rather than in neatly spaced-apart intervals which has been required in many lid operations in the past. The actuation of pre-setting means 51 and the leveling step facilitated by leveling means 57 both occur immediately after dispensing from slide means 33. Thus a lid 24, despite typically encountered irregularities in both the lid 24 and pail receptacles 41, may be lightly pre-set to allow it to move along conveyor means 38 without vibrating from position atop upper rim 42.

Figure 4:
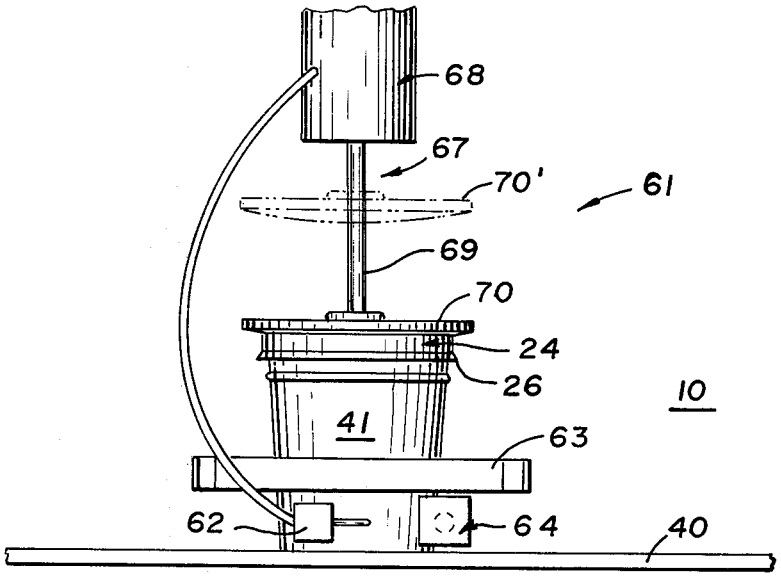
FIG. 4 is an elevational view of another portion of the apparatus as shown in FIG. 1.

With reference taken now to FIG. 1 and FIG. 4, the final securement, or placement, of a lid 24 along an upper rim 42 is shown. This final placement is obtained by the provision of lid securement means 61 disposed a distance along conveyor means 38 from pre-setting means 51. Lid securement means 61 comprises switch means 62, side rails 63, detaining means 64 and securement means 67. Switch means 62 is contacted by an advancing pail receptacle 41. Side rails 63 are positioning means which position a pail receptacle 41 generally along the central longitudinal axis of moving surface 40 thereby ensuring proper registry for lid placement by securement means 67. Switch means 62, similar to switch means 52 and 53, comprises an electrical switching device in the preferred embodiment, but air switches may be suitable substitutes. Switch means 62 cooperates with a later-described time delay whereby detaining means 64 is initially actuated followed by the actuation of securement means 67. Detaining means 64 comprises an air cylinder assembly 65 having a piston 66 cooperative therewith. Air cylinder assembly 65 is preferably horizontally mounted wherein piston 66 travels transverse inwardly of moving surface 40 to obstruct and detain a moving pail receptacle 41 momentarily in registry with securement means 67 while moving surface 40 moves beneath it. Other dispositions for air cylinder assembly 65 may be utilized as would be well understood to one skilled in the art. Upon detaining a pail receptacle 41 by detaining means 64, securement means 67 is activated. Securement means 67 facilitates the final setting, placing, burping and snapping of a lid 24 along an upper rim 42. Securement means 67 comprises air cylinder assembly 68, which is preferably larger than air cylinder 54, since it is required to burp and snap a lid 24. Air cylinder assembly 68 includes piston 69 which travels vertically. Piston 69 terminates in a plate 70 which preferably has a convex lower surface, but a flat surface may be suitably substituted. As piston 69 descends plate 70 contacts upper surfaces of central circular plate 25 and portions above peripheral lip 26 generally along trough 27. With a convex configuration, central circular plate 25 is first depressed generally in its central portion and thence radially outwardly thereof to expunge excess air volumes within pail receptacles 41. This is termed burping. As outer portions of plate 70 continue to descend and contact circular plate 25, peripheral lip 26 is snap-engaged over rib 43 in a finally placed position. The pressing of plate 70 is controlled by a later described circuit controlling means and the length of actuation of securement means 67 may be varied depending on the necessary time to facilitate final lid placing. Securement means 67 is then de-activated and piston 69 moves upwardly while detaining means 64 is de-activated permitting pail receptacles 41 to again advance along moving surface 40 away from lid securement means 61.

Following actuation of lid securement means 61, pail receptacles 41 advance along conveyor means 38 to other points in a plant operation whereupon filled and lidded pail receptacles may be stored, shipped, or labeled, as required by a particular operation.

While the preferred embodiment for lid placing apparatus 10 is shown with magazine section 11 and conveyor means 38 generally in parallel alignment with the former directly above the later, other suitable alternative alignments are envisioned within the purview of the invention. With advancement in magazine section 11 desirably occurring in one direction and pail receptacle 41 advancement along conveyor means 38 in the opposite direction, directly below magazine section 11, compactness is afforded which may be desirable when factory space is limited. However, slide means 33 may be suitably formed to include an inclined plate 34 which may be a spiral, or other configuration, wherein disposition of retained lids 24 may be provided transverse or skewed to the direction of advancement in magazine section 11, at an angle compatible with the disposition of conveyor means 38. Additionally, inclined plate 34 is shown as preferably inclining generally back toward magazine section 11. However, inclined plate 34 may incline in a direction away from magazine section 11 for receiving falling lids 24 and thereby allowing them to slide by gravity. Such alternate configurations for the alignment of magazine section 11 with respect to conveyor means 38 is well within the scope of the invention, as would be understood by one skilled in the art, and could be obtained by varying the configuration of inclined plate 34 of slide means 33.

Figure 5:
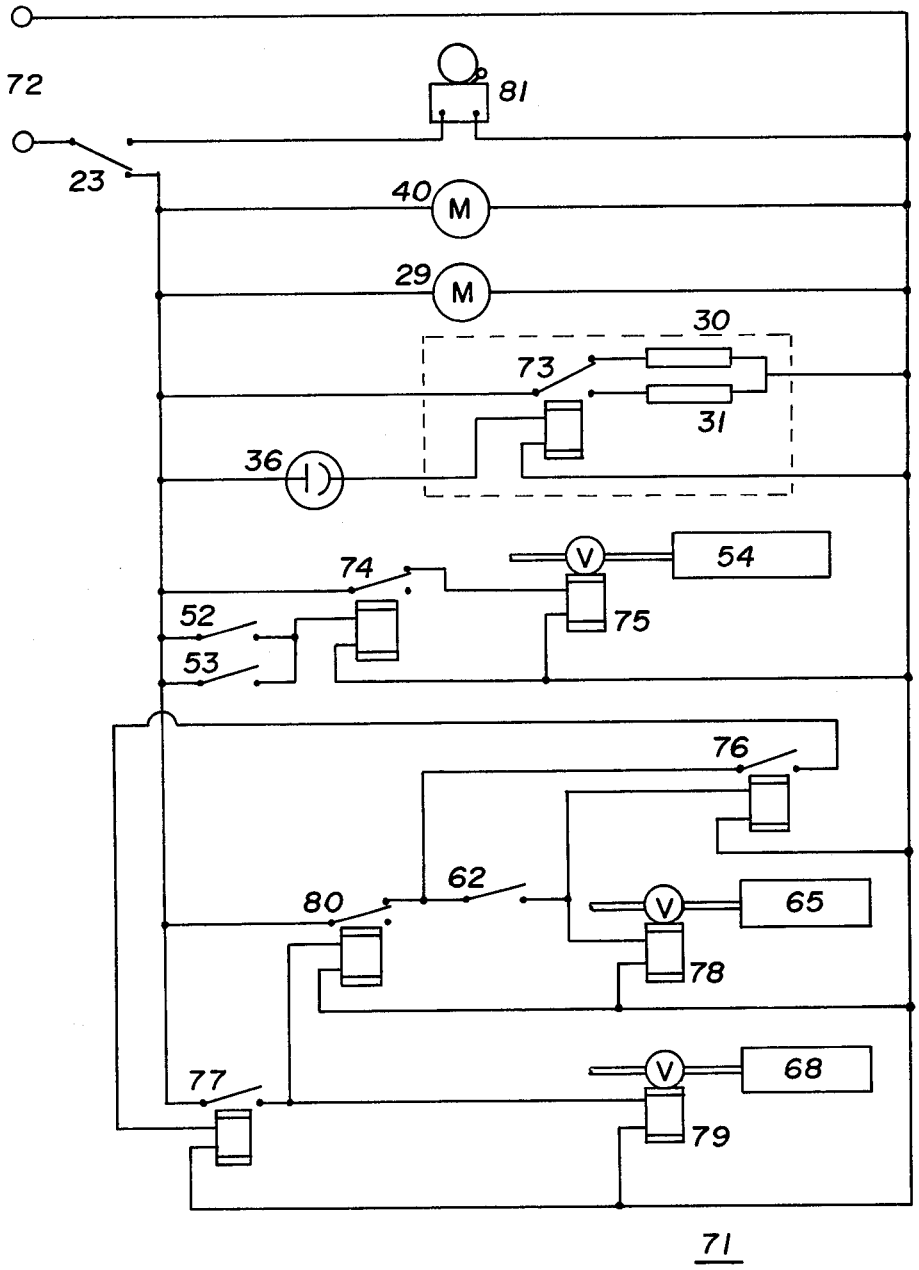
FIG. 5 is a schematic showing the wiring diagram of electrical circuit controlling means in the preferred embodiment for this invention.

With reference now made to FIGS. 1 and 5, lid placing apparatus 10 and method herein described, are effectuated by circuit controlling means 71 which sequences the automatic operation of lid placing apparatus 10. The previously described components are related as shown in the wiring diagram of FIG. 5. While the preferred embodiment for this wiring diagram is shown, suitable alternatives may be adapted for use well within the scope of this invention. Circuit controlling means 71 is energized by power source 72 in a conventional manner. With a fully loaded magazine section 11 and a lid 24 retained at stop means 35, a pail receptacle is conveyed under lower portion 37 of inclined plate 34, and draws off a lid 24 which closes the electric eye sensor means 36. This energizes control relay 73 opening normally closed contacts to brake 20 and closing contacts to clutch 31 thereby engaging clutch 31 with electric motor 29. Electric motor 29, utilized for magazine drive means 28, preferably comprises a ¼ horsepower conventionally designed electric motor. Thereupon, threaded rods 16 rotate, when clutch 31 engages, and advances platen assembly 18, which pushes a lid 24 to discharge from compression section 19 and fall onto inclined plate 34. This then opens electric eye sensor means 36 upon retention at stop means 35 and drops out control relay 73, disengaging clutch 31 and activating brake 30 to thereby disengage electric motor 29 and stop advancement of platen assembly 18.

A pail receptacle 41 with a lid 24 lightly in place advances along conveyor means 38 and contacts switch means 52. On contact with switch means 52, time delay relay 74 is open which activates solenoid valve 75 thereby sending air to air cylinder assembly 54 of presetting means 51. A lid 24 is thereby tapped above the leading edge 44 of pail receptacle 41. The pail receptacle 41 continues along conveyor means 38 and contacts switch means 53. This again opens time delay relay 74 again activating solenoid valve 75 to send air to air cylinder assembly 54 to tap a lid 24 above trailing edge 45 of a pail receptacle 41. The pail receptacle 41 is conveyed further down conveyor means 38 and contacts switch means 62 energizing contact relay 76. Contacts of contact relays 76 are thereby closed to act as holding contacts for time delay relay 77 thus energizing solenoid valve 78 sending air to air cylinder assembly 65 of lid securement means 61 for detaining the pail receptacle 41. Conveyor means 38 continues to run during operation of detaining means 64. When time delay relay 77 times out it closes contacts and energizes solenoid valve 79. Air is then sent to air cylinder assembly 68 causing piston 69 to descend and burp and snap lid 24 firmly in place. Time delay relay 77 also energizes time delay relay 80 which controls the length (duration) of the stroke of piston 69.

When magazine section 11 reaches near empty, approximately when lids 24 are only contained in compression portion 19, shut-off switch means 53 is contacted by platen assembly 18. Alarm 81 thereby sounds and electric motor 29 is deenergized. Also, switch means 23 de-energizes electric motor 39 comprising the conveyor drive means for conveyor means 38. When conveyor means 38 is running there is power to the lid placing apparatus controls. Upon re-loading magazine section 11, shut-off switch means 23 contacts close thereby energizing circuit controlling means 71 for continuous automatic lid placement operations.

It is thus apparent that an automatic lid placing apparatus for large plastic lids and a method for placing large plastic lids has been disclosed which fully solves all the problems encountered by the industry when attempting to place lids onto large pail receptacles. While a preferred embodiment has been shown for this invention, it is intended that the invention include all variations within its scope as would be well understood by one skilled in the related arts.

What is claimed is:

1. An apparatus for automatically placing large plastic lids which comprises:

a magazine section capable of storing juxtaposed plastic lids, said magazine section having lid advancing means comprising at least one threaded rod for advancing an engaged platen and thereby push lids to advance along lid support portions extending between plate members;

said threaded rod supported at opposite ends and seated in bearings permitting rotation, said magazine section having a compression portion for holding lids tightly facilitating discharge of only one lid at a time, said compression portion including lid discharging means;

drive means comprising a motor and cooperative brake and clutch assembly controlling rotation of a threaded rod to effect advancement of plastic lids and facilitate discharge of one lid at a time;

slide means for receiving lids discharging from the magazine section, said slide means comprising an inclined plate capable of receiving falling lids and allowing lids to slide downwardly to a lower portion thereof, stop means extending from said inclined plate for retaining lids wherein a portion of a lid extends beyond said inclined plate, said slide means associated with electric eye means capable of detecting a lid retained by said stop means and signalling said brake and clutch assembly of the drive means to disengage the motor upon detection of a lid reaching the retained position and capable of signalling said brake and clutch assembly to re-engage the motor when a lid is not retained;

conveyor means including conveyor drive means activating a moving horizontal surface for advancing pail receptacles, said conveyor means disposed below the slide means a sufficient distance whereby upper rim portions of pail receptacles encounter said portion of a retained lid extending beyond the lower portion of the slide means, whereby a leading edge of the upper rim of a pail receptacle encounters said extending portion of the lid and draws a lid off said stop means from retained position to dispense atop a pail rim;

guiding means to guide a dispensing lid onto a pail receptacle, said guiding means comprising a roller supported by hinged arms, said roller disposed adjacent said slide means and positioned for rolling contact across upper surfaces of a lid to guide a lid onto a pail receptacle as it dispenses from the slide means;

air cylinder and piston means for pre-setting lids on pails, said air cylinder and piston means cooperative with switch means disposed along the conveyor means, the switch means triggered by advancing pail receptacles thereby activating the air cylinder and piston means to tap a lid into pre-set engagement along the upper rim portion of a pail receptacle;

lid leveling means for positioning pre-set lids on pail receptacles, said lid leveling means comprising a horizontally fixed roller adjacent said air cylinder means, said roller positioned at a height sufficient to rotate and contact across upper surfaces of advancing lids thereby leveling in generally horizontal disposition;

lid securement means for final lid placement comprising pail receptacle detaining means cooperative with an air cylinder and piston assembly, said lid securement means activated in response to switch means triggered by an advancing pail receptacle, whereby said pail receptacle detaining means is capable of momentarily detaining a pail receptacle on the conveyor means in registry with said piston whereupon said air cylinder is sequentially activated causing said piston to descend and press atop a lid to place it firmly atop a pail receptacle; and, electrical circuit means correlating apparatus operations to automatically sequence lid advancement by controlling engagement of the magazine drive means by means of said brake and clutch assembly activating in response to the electric eye means and by controlling the conveyor drive means and magazine drive means in response to the platen advancing in the magazine to trigger a shut-off switching means adapted to de-energize said conveyor drive means and magazine drive means thereby facilitating re-loading of the magazine section;

wherein said automatic lid placing apparatus facilitates sequentially affixing large plastic lids on pail receptacles.

2. An apparatus for automatically placing large plastic lids as claimed in claim 1 wherein the compression portion of the magazine section includes spring means compressing advancing lids transverse to the direction of advancement.

3. An apparatus for automatically placing large plastic lids as claimed in claim 1 wherein the magazine drive means mechanically engages a threaded rod by belt drive means.

4. An apparatus for automatically placing large plastic lids as claimed in claim 1 wherein the air cylinder and piston assembly of the lid securement means includes a circular plate at the end of said piston facilitating pressing a lid in place.

5. An apparatus for automatically placing large plastic lids as claimed in claim 1 wherein the pail receptacle detaining means comprises a horizontally disposed air cylinder and piston assembly which when activated by said switch means projects said piston into the path of an advancing pail receptacle to thereby detain a pail receptacle during lid securement.

6. An apparatus for automatically placing large plastic lids as claimed in claim 5 wherein said lid securement means includes positioning means disposed along a portion of both sides of the conveyor means facilitating lid registry with said descending piston.

7. An apparatus for automatically placing large plastic lids as claimed in claim 1 wherein the air cylinder and piston means for pre-setting lids is cooperative with two spaced-apart switch means disposed along the conveyor means whereby an advancing pail sequentially triggers both air switch means to activate the air cylinder and piston means to tap a lid twice.

8. An apparatus for automatically placing large plastic lids as claimed in claim 7 wherein the two switch means are positioned to activate said pre-setting air cylinder and piston means to tap a lid first at the leading peripheral edge, and second at the trailing peripheral edge.

9. An apparatus for automatically placing large plastic lids as claimed in claim 1 wherein the apparatus is adapted to accommodate plastic lids having diameters in the range of from about 6″ to about 18″.

10. An apparatus for automatically placing large plastic lids as claimed in claim 1 wherein the apparatus is capable of accommodating plastic lids having circumferential lips with a height of from about ¼″ to about 2″ extending from the periphery of a circular plate-like central lid portion.

11. An apparatus for automatically placing large plastic lids as claimed in claim 1 wherein the magazine section, slide means, conveyor means, guiding means, pre-setting air cylinder and piston means, leveling means, and lid securement means are adjustable for accommodation of varying size lids and pail receptacles.

12. An apparatus for automatically placing large plastic lids as claimed in claim 11 which is capable of alteration for varying lid and pail receptacle sizes wherein said conveyor means is vertically adjustable relative to said magazine section; said magazine section includes adjustable lid support portions; the guiding means, presetting air cylinder and piston means, leveling means, are adjustable relative to said conveyor means, and, said lid securement means is adjustable relative to said conveyor means.

13. An apparatus for continuously placing large plastic lids on pail receptacles comprising in combination:

a magazine section for storing plastic lids;

drive means comprising a motor cooperative with a brake and clutch assembly driving the magazine section for advancing plastic lids;

slide means adjacent one end of the magazine section for receiving falling plastic lids as they discharge from the magazine section, said slide means including stop means at a lower portion thereof for holding a plastic lid at said lower portion wherein a lid is retained with a leading portion extending beyond the lower portion of the slide means;

conveyor means capable of continuously advancing pail receptacles below said lower portion of the slide means wherein the conveyor means is disposed vertically below said slide means at a distance permitting an upper rim of a pail receptacle to positionally correspond with the portion of the lid extending beyond the lower portion of the slide means thereby facilitating a leading rim edge of an advancing pail receptacle to catch a lid lip and pull it from the slide means;

guiding means providing a downward force and comprising a roller supported by hinged arms for rolling over upper surfaces of lids to guide lids from the slide means onto a pail receptacle;

pre-setting means comprising an air cylinder having a vertically disposed piston actuated by switch means triggered by advancing pail receptacles which actuate the piston to tap an upper edge of the lid thereby pre-setting a lid onto a pail receptacle;

lid leveling means positioned at a height above said conveyor means sufficient to contact an upper surface of an advancing lid and position the lid in a generally horizontal plane on a pail receptacle;

lid securement means comprising pail receptacle detaining means and an air cylinder and piston assembly actuated by switch means triggered by advancing pail receptacles, said detaining means effecting momentary stoppage whereupon said air cylinder and piston assembly activates causing said piston to burp and press a pre-set lid to place it firmly atop a pail receptacle; and, controlling means comprising electric circuitry which alternately activates and de-activates said brake and clutch assembly associated with the motor of said magazine drive means in response to the electric eye means and wherein said controlling means energizes the conveyor drive means and the magazine drive means responsive to switching means associated with the magazine section;

wherein said apparatus facilitates automatic operation.

14. An apparatus as in claim 13 wherein a portion of the magazine section adjacent the discharging end of the magazine section comprises a compression portion wherein lids are compressed edgewise facilitating discharge therefrom one at a time.

15. An apparatus as claimed in claim 13 wherein the magazine drive means is mechanically linked to the magazine section by belt drive means connected to threaded rods which responsively spin to advance plastic lids by means of a platen engaging said threaded rods, said platen capable of pushing stored lids toward the discharge end of the magazine section when the motor of the drive means is engaged.

16. An apparatus as claimed in claim 13 wherein the pre-setting means includes two spaced-apart switch means sequentially triggered by advancing pail receptacles thereby actuating the piston of the air cylinder and piston assembly to move downwardly twice and tap a lid into pre-set position onto an advancing pail by tapping downwardly at the leading peripheral edge of the lid and secondly at the trailing peripheral edge of the lid.

17. An apparatus as claimed in claim 13 wherein a circular plate is included at the lower portion of the piston of the air cylinder and piston assembly of the lid securement means facilitating contact with a lid for burping and snapping a lid into place firmly atop a pail receptacle.

18. An apparatus as claimed in claim 13 wherein said apparatus is capable of alteration for varying lid and pail receptacle sizes wherein said conveyor means is vertically adjustable relative to said magazine section, said magazine section includes adjustable lid support portions, both the pre-setting and lid securement assembly means are adjustable relative to said conveyor means, and, said guiding means is adjustable relative to the lower portion of the slide means.

19. A method for dispensing large plastic lids and placing the lids on continuously advancing pail receptacles, said method comprising the steps of:

loading plastic lids in a magazine section with said lids positioned in a juxtaposed relationship;

advancing said lids in the magazine by drive means cooperating with the magazine;

compressing lids to hold them tightly in an end compression portion of the magazine section;

discharging lids one at a time from the compression portion of the magazine section;

sliding a lid down an inclined plate by gravity;

retaining a lid at a lower portion of the inclined plate with a portion of a circumferential lid lip extending beyond said inclined plate;

stopping the magazine drive means upon retention of a lid on the inclined plate;

continuously conveying pail receptacles by conveyor means extending below the lower portion of the inclined plate;

catching said extending portion of a lid lip with a leading rim edge of an advancing pail receptacle passing beneath the lower portion of the inclined plate;

dispensing a lid from the inclined plate by means of an advancing pail drawing a lid off the inclined plate;

guiding a dispensing lid by roller means contacting upper surfaces of the lid until the lid rests atop a pail receptacle;

re-starting the magazine drive means thereby advancing a sequential lid to discharge from the magazine section and thereafter slide down the inclined plate to the retained position;

conveying a pail and lid on the conveying means;

tapping a lid by means of an air cylinder and piston assembly to pre-set a lid lip around an upper rim of a pail receptacle;

leveling a pre-set lid on a pail receptacle by means of a horizontally disposed roller to position the pre-set lid in a generally horizontal position;

setting the lid in final placement onto the pail receptacle by detaining the pail and sequentially pressing the lid into final placement by activating an air cylinder and piston assembly to burp the lid and snap the lid lip around an upper pail rim of a pail receptacle; and, advancing a pail and affixed lid along the conveyor means.

20. A method for dispensing large plastic lids and placing the lids on continuously advancing pail receptacles as claimed in claim 19 wherein the step of pre-setting a lid by an air cylinder and piston assembly includes first tapping a leading peripheral edge of a lid and a second tapping at a trailing peripheral edge of the lid.

21. A method for dispensing large plastic lids and placing the lids on continuously advancing pail receptacles as claimed in claim 19 wherein the air cylinder and piston assemblies are actuated by advancing pail receptacles triggering switch means disposed along the conveyor means.

22. A method for dispensing large plastic lids and placing the lids on continuously advancing pail receptacles as claimed in claim 19 wherein the step of dispensing a lid from the inclined plate includes the step of signalling the drive means by electric eye detection means cooperating with the inclined plate, and sequentially advancing another lid to discharge from the magazine section and slide down the inclined plate.

23. A method for dispensing large plastic lids and placing the lids on continuously advancing pail receptacles as claimed in claim 19 wherein the method includes continuously dispensing lids one at a time by starting and stopping the magazine drive means effectuated by braking and clutching the drive means in response to said electric eye detection means.

24. A method for dispensing large plastic lids and placing the lids on continuously advancing pail receptacles as claimed in claim 19 wherein the step of advancing lids in the magazine section includes the steps of rotating threaded rods in the magazine section, advancing an engaged platen, and, pushing lids to advance.

25. A method for dispensing large plastic lids and placing the lids on continuously advancing pail receptacles as claimed in claim 19 wherein the step of loading the lids in the magazine section includes the step of loading the lids with circumferential lip portions thereof faced in the direction of advancement.

26. A method for placing large plastic lids on pail-type receptacles, said method comprising the steps of:

loading plastic lids in a generally horizontal magazine section with lids disposed vertically in juxtaposition;

advancing said lids in the magazine section;

compressing a group of lids in an end portion of the magazine section;

discharging a lid from the magazine section to fall onto a slide plate while retaining a next adjacent sequential lid in the magazine section;

sliding said discharged lid down a slide plate by gravity;

retaining the lid at a lower portion of the slide plate at stop means;

stopping engagement of magazine drive means upon retention of the lid at the stop means;

continuously conveying pail receptacles on conveyor means beneath said slide plate;

catching a lip portion of the lid at a leading rim edge of a pail receptacle;

dispensing the lid from the slide plate by means of the pail rim edge pulling the lid off the stop means;

guiding the lid into position onto the pail receptacle;

re-engaging the magazine drive means and advancing a next sequential lid to discharge from the magazine section and fall onto the slide plate;

conveying the pail and dispensed lid on said conveyor means;

tapping the lid to pre-set position atop the pail receptacle by means of the moving pail receptacle triggering switch means to activate an air cylinder and piston assembly thereby motivating a piston means to descend and tap the lid;

leveling the lid in pre-set position atop the pail receptacle by use of a horizontally disposed roller contacting across upper surfaces of said lid;

securing the lid in fixed position atop the pail receptacle by means of the moving pail triggering a switch means to activate a detaining means and activating sequentially an air cylinder and piston assembly thereby causing a piston means to descend and burp and snap the lid to firmly place the lid atop the pail receptacle;

advancing the pail receptacle and placed lid on said conveyor means; and, automatically repeating the sequence of steps for the next sequential lid thereby continuously placing lids atop pail receptacles.

27. A method as claimed in claim 26 wherein the step of pre-setting a lid includes two activations of said air cylinder and piston assembly, first tapping a leading peripheral edge of a lid and a second tapping at the trailing peripheral edge of the lid.

* * * * *